United States Patent [19]

Springer et al.

[11] Patent Number: 4,863,376

[45] Date of Patent: Sep. 5, 1989

[54] WALKING BEAM FURNACE

[75] Inventors: Helmut A. Springer; Dieter R. Schwab, both of Düsseldorf; Augusto Funghini, Solingen, all of Fed. Rep. of Germany

[73] Assignee: Italimpianti S.p.A., Genoa, Italy

[21] Appl. No.: 159,699

[22] Filed: Feb. 24, 1988

[30] Foreign Application Priority Data

Feb. 24, 1987 [DE] Fed. Rep. of Germany ..... 3705822

[51] Int. Cl.[4] ..... F27B 9/14

[52] U.S. Cl. ..... 432/122; 432/123; 432/243

[58] Field of Search ..... 432/122, 123, 239, 243, 432/127

[56] References Cited

U.S. PATENT DOCUMENTS

| | | | |
|---|---|---|---|
| 3,554,505 | 1/1971 | Dessarts et al. | 432/122 |
| 3,749,550 | 7/1973 | Suydam | 432/243 |
| 3,887,064 | 6/1975 | Brockmann | 432/243 |
| 4,579,523 | 4/1986 | Laiquddin et al. | 432/5 |
| 4,648,837 | 3/1987 | Funghini et al. | 432/122 |

*Primary Examiner*—Henry C. Yuen

*Attorney, Agent, or Firm*—Toren, McGeady & Associates

[57] ABSTRACT

A walking beam furnace with a hearth of fixed beams and of walking beams arranged on supports passing through slots in the floor of the furnace in which, so as to avoid heat loss and undesired heating of the supports in the region of the floor slots, covers are provided for the floor slots that are movable with the supports in at least the feed direction.

2 Claims, 3 Drawing Sheets

Fig. 4
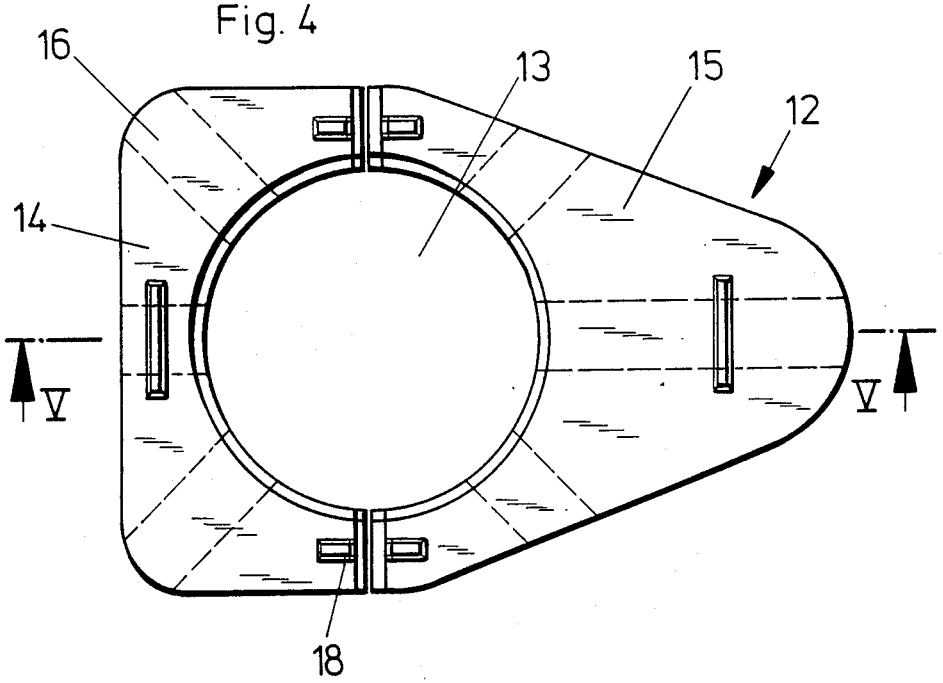
Fig. 5
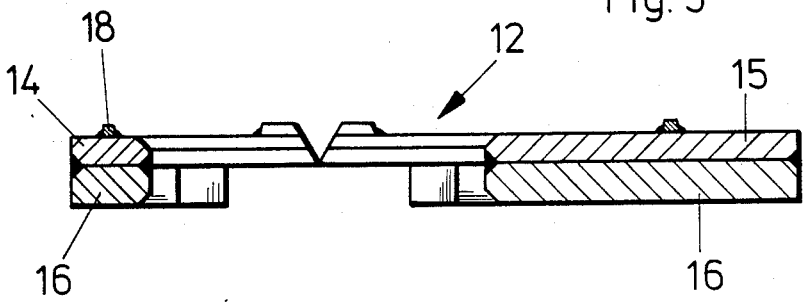
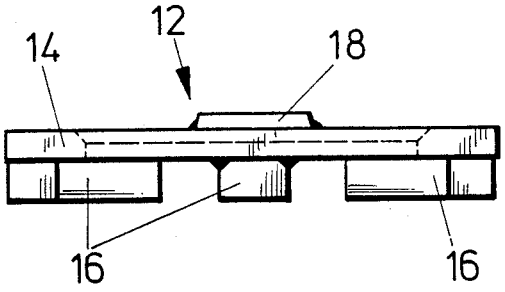
Fig. 6

WALKING BEAM FURNACE

TECHNICAL FIELD OF THE INVENTION

The invention relates to a walking beam furnace with a hearth of fixed beams and of walking beams arranged on supports passing through slots in the floor of the furnace.

BACKGROUND OF THE INVENTION AND PRIOR ART

A walking beam furnace of this kind is described in the German Offenlegungsschrift 34 40 126. In this walking beam furnace the slots in the floor have to be big enough to ensure free movement of the walking beam supports in the feed direction without jamming due to the unavoidable manufacturing tolerances and thermal expansions.

For a feed and lift each of e.g. about 300 mm and a support diameter of about 200 mm, the length of the floor opening therefore amounts to 600 mm and the width to about 300 mm. Thus outside the support region there is a free space about 400 mm in length and 100 mm in width. As there are a large number of these floor openings in the walking beam furnace considerable radiation losses occur, resulting in a considerable loss of heat.

OBJECT OF THE INVENTION

The object of the invention is therefore to improve the walking beam furnace of the kind mentioned above so as to substantially reduce the loss of heat.

BRIEF DESCRIPTION OF THE INVENTION

According to the invention this object is achieved in a walking beam furnace of the kind mentioned above by covers for the floor slots which are movable with the supports in at least the feed direction.

The covers are preferably fixed to the supports and therefore not only move in the feed direction with the supports but also in the lifting direction.

Each cover advantageously consists of an elongated steel shoe and insulation of refractory material enclosing it and covering over the slots in the floor. The steel shoe can consist of two steel plates, each half-embracing a support, that are reinforced by radial ribs and are welded to the supports.

When the walking beams are stationary the covers are a short distance from the floor of the furnace, so that in this position only a little radiation can escape. The radiation losses during the lifting and feed movement of the walking beams are small, as transportation by the walking beams occurs within a few seconds, followed by a transportation break of a few minutes during which the material being annealed rests on the fixed beams and the walking beams are in their lower position so that the slots in the floor are substantially covered by the covers.

BRIEF DESCRIPTION OF THE DRAWINGS

The invention will now be described in more detail with reference to an exemplary embodiment shown in the drawings, in which FIG. 4 shows a top view of a steel shoe according to the invention, FIG. 5 shows a section on the line V—V in FIG. 4 and FIG. 6 shows a side view of the steel shoe of FIG. 4.

DETAILED DESCRIPTION OF THE INVENTION

Figure 1:
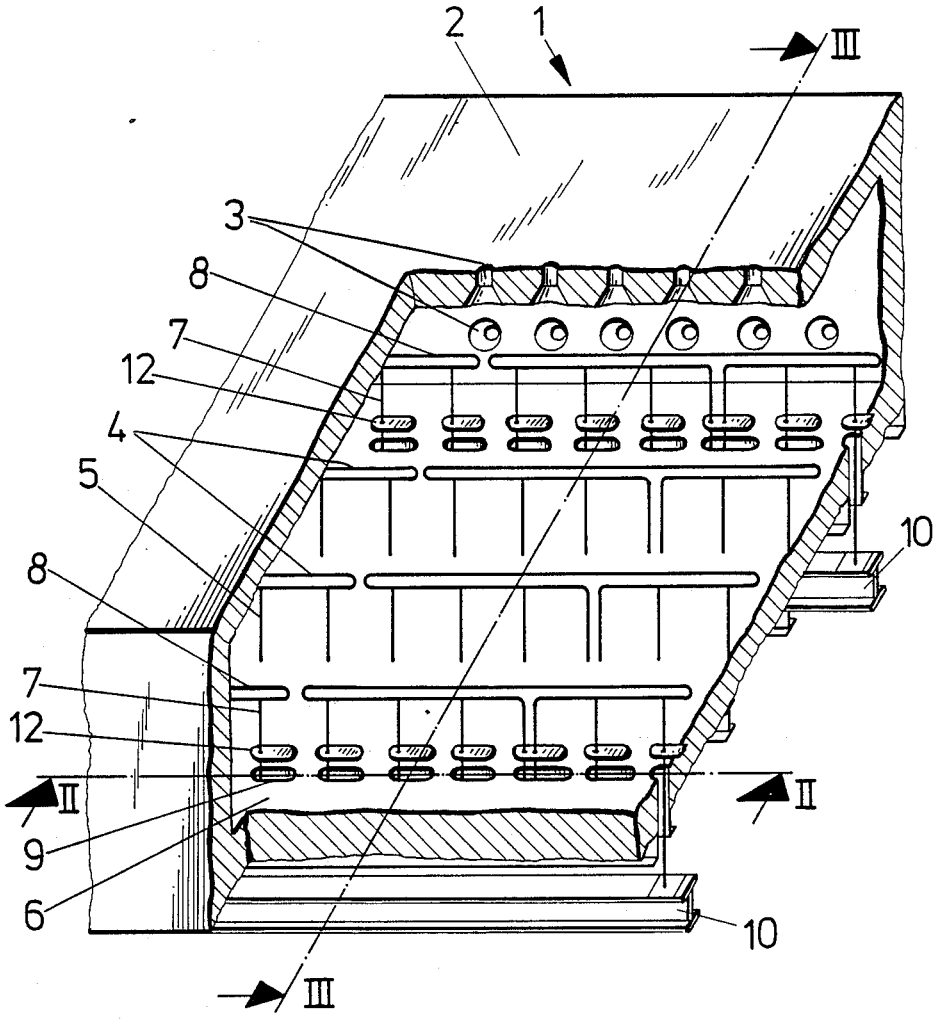
FIG. 1 shows a perspective sectional view of a walking beam furnace.
Figure 2:
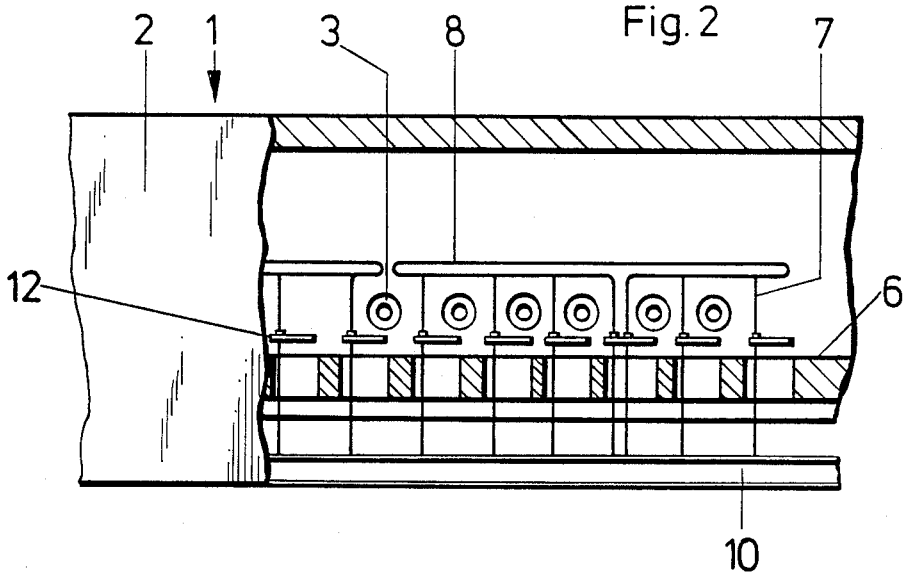
FIG. 2 shows a part sectional view on the line II—II in FIG. 1.
Figure 3:
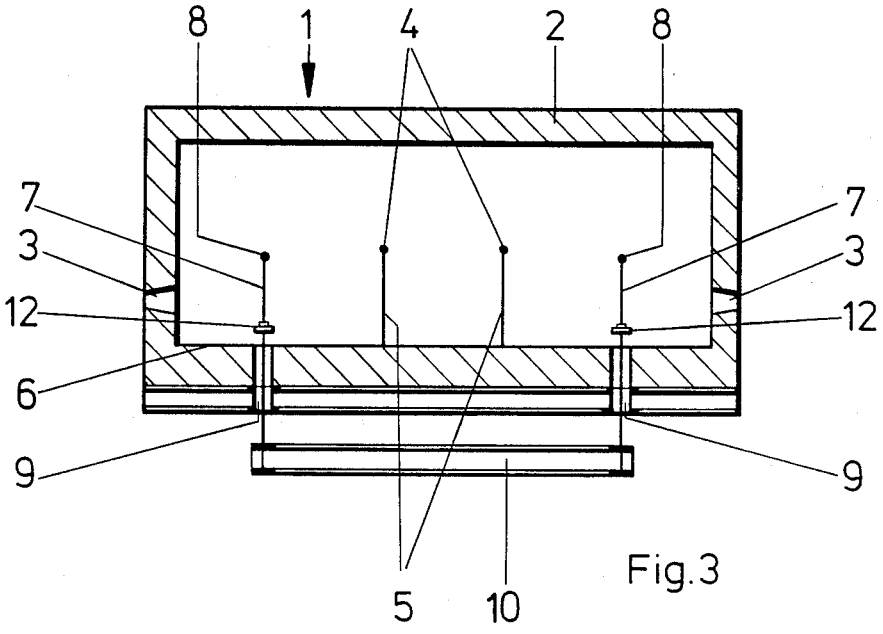
FIG. 3 shows a part sectional view on the line III—III in FIG. 1.

A walking beam furnace 1 essentially comprises a refractory housing 2 with roof and side burners 3. Fixed beams 4 rest with supports 5 on the floor of the furnace 6, whilst supports 7 of walking beams 8 project through slots in the floor of the furnace 6 and are arranged on a common travelling frame 10. The travelling frame 10, which is driven by cylinders, moves with rollers on level rails which are arranged on a lifting frame that is driven by lifting cylinders and rolls with rollers on inclined rails, giving an oblique lifting and a horizontal movement of the walking beams.

Arranged on the tubular supports 7 for the walking beams 8 in the region of the floor slots are elongated covers which comprise steel shoes 12 fixed to the supports 7 and insulation of refractory material (not shown) enveloping the latter.

The steel shoes 12 consist of two halves 14, 15 each having a semicircular recess, which together form a hole 13 for the support 7. Welded beneath the steel shoe halves 14, 15 are radial reinforcing ribs 16. On the surface of the steel shoe 12 are lugs 18 which cooperate with corresponding depressions in the insulation and position the latter on the steel shoe 12.

A steel intermediate ring may be located on each insulating member which ring also has positioning lugs on both sides. These positioning lugs hold insulating rings of refractory material around the supports, if the insulating rings are without such lugs.

The steel shoes 12 can be manufactured by welding—as shown—or as steel castings.

What is claimed is:

1. A walking beam furnace comprising a furnace floor, a hearth made up of fixed beams and of walking beams movable in a feeding direction and arranged on supports passing through slots in the furnace floor, said slots in the floor being provided with covers arranged on and movable with the supports in at least the feeding direction and provided so as to prevent passage of head radiation, and driving means arranged beneath the furnace floor for moving the walking beams via the supports, the covers each comprising an elongated steel shoe and refractory material insulation enveloping the shoe and covering the corresponding slot in the floor, each steel shoe being made up of two steel plates each of which is fixed to and half-embraces a support and is reinforced with radially ribs.

2. A walking beam furnace comprising a refractory housing having a passage therein and a furnace floor having slots therethrough extending parallel to said passage, a plurality of fixed beams in said housing extending along said passage, a plurality of walking beams mounted for movement in the passage, a plurality of supports connected to each walking beam and extending through said slots, drive means provided beneath said furnace floor and connected to said supports for moving said supports and said walking beams in said passage, and a cover arranged on each support above each respective slot for at least partly covering each slot during movement of said support so as to prevent passage of heat radiation, each of said covers comprising an elongated steel shoe and refractory material insulation enveloping said shoe and covering the corresponding slot in the floor, each steel shoe being made up of two steel plates each of which is fixed to and half-embraces a support and is reinforced with radially ribs.

* * * * *

UNITED STATES PATENT AND TRADEMARK OFFICE

CERTIFICATE OF CORRECTION

PATENT NO. : 4,863,376

DATED : September 5, 1989

INVENTOR(S) : Helmut Albert Springer

It is certified that error appears in the above-identified patent and that said Letters Patent is hereby corrected as shown below:

In the heading of the Patent, it should read:

[73] Assignee: Italimpianti S.p.A., Genova, Italy

Signed and Sealed this

Second Day of October, 1990

*Attest:*

HARRY F. MANBECK, JR.

*Attesting Officer*

*Commissioner of Patents and Trademarks*